US008216033B2

(12) United States Patent
Ball

(10) Patent No.: US 8,216,033 B2
(45) Date of Patent: Jul. 10, 2012

(54) LOW PRESSURE BLOW-OFF ASSEMBLIES AND RELATED METHODS

(75) Inventor: Edward Kelly Ball, Eureka, MO (US)

(73) Assignee: Process Air Solutions, LLC, Fenton, MO (US)

( * ) Notice: Subject to any disclaimer, the term of this patent is extended or adjusted under 35 U.S.C. 154(b) by 896 days.

(21) Appl. No.: 12/198,012

(22) Filed: Aug. 25, 2008

(65) Prior Publication Data

US 2009/0215377 A1 Aug. 27, 2009

Related U.S. Application Data

(60) Provisional application No. 61/030,920, filed on Feb. 22, 2008.

(51) Int. Cl.
*F24F 13/00* (2006.01)

(52) U.S. Cl. ..... 454/66; 34/107; 34/636

(58) Field of Classification Search ..... 118/58, 118/62, 306, 317, 408, 63; 134/15, 37, 64 R; 15/301, 306.1, 405, 303, 316.1; 427/348, 427/349; 454/66; 34/579
See application file for complete search history.

(56) References Cited

U.S. PATENT DOCUMENTS

| | | | | |
|---|---|---|---|---|
| 1,811,505 | A * | 6/1931 | Kennedy | 118/405 |
| 2,194,565 | A | 3/1940 | Moss | |
| 2,536,208 | A * | 1/1951 | Nystrom | 134/15 |
| 3,060,889 | A * | 10/1962 | Knapp | 118/63 |
| 3,270,364 | A * | 9/1966 | Steele | 15/309.1 |
| 3,533,761 | A * | 10/1970 | Pierson | 428/629 |
| 3,611,986 | A * | 10/1971 | Pierson | 118/63 |
| 3,668,008 | A * | 6/1972 | Severynse | 134/1 |
| 3,707,400 | A | 12/1972 | Harvey et al. | |
| 3,722,077 | A * | 3/1973 | Armstrong | 29/527.4 |
| 3,736,174 | A * | 5/1973 | Moyer | 427/349 |

(Continued)

FOREIGN PATENT DOCUMENTS

WO WO 90/14567 11/1990

OTHER PUBLICATIONS

EXAIR: Manufacturing compressed air products since 1983, http://www.exair.com/Cultures/en-US/Products/default.htm?CatalogNavigationBreadCrumbs=Air%20Wi . . . , printed as of Oct. 19, 2007, 3 pages.

*Primary Examiner* — Steven B McAllister
*Assistant Examiner* — Jamil Decker
(74) *Attorney, Agent, or Firm* — Harness, Dickey & Pierce, P.L.C.

(57) ABSTRACT

A low pressure blow-off assembly provides converging airflow around a length of material moving through the assembly. The assembly generally includes a body having an interior wall and an exterior wall. The interior wall defines a bore extending through the body for receiving the material through the body, and the exterior wall surrounds the interior wall and defines an air reservoir within the body generally between the exterior wall and interior wall. A cap is configured to be coupled to the body to cover at least part of the air reservoir. The bore includes a generally tapered end and the cap includes a generally tapered inner lip, where the tapered end of the bore and the tapered inner lip of the cap define an opening therebetween for discharging air from the air reservoir through the opening in a generally converging airflow pattern around the material passing through the body.

21 Claims, 11 Drawing Sheets

U.S. PATENT DOCUMENTS 3,736,618 A * 6/1973 Ramsey ..... 15/309.1
3,800,435 A 4/1974 Woellner
3,873,293 A * 3/1975 Rudd et al. ..... 65/84
3,906,672 A * 9/1975 Kobayashi ..... 451/75
3,917,888 A * 11/1975 Beam et al. ..... 427/433
4,033,785 A 7/1977 Gibbs
4,287,238 A * 9/1981 Stavros ..... 427/349
4,296,556 A * 10/1981 Bray ..... 34/107
4,339,480 A * 7/1982 Stavros et al. ..... 427/349
4,421,054 A * 12/1983 Stavros ..... 118/63
4,461,654 A * 7/1984 Stalson et al. ..... 134/10
4,552,788 A 11/1985 Sato et al.
4,850,378 A * 7/1989 Mattiussi ..... 134/15
5,061,522 A 10/1991 Copas et al.
5,066,519 A 11/1991 Robertson
5,121,573 A * 6/1992 Vassena ..... 451/312
5,174,829 A 12/1992 Gray
5,179,830 A 1/1993 Donath
5,346,551 A * 9/1994 Pannenbecker et al. ..... 118/63
5,389,148 A * 2/1995 Matsunaga ..... 118/300
5,518,854 A * 5/1996 Yu et al. ..... 430/133
5,634,236 A * 6/1997 Darsey ..... 15/309.1
5,665,161 A * 9/1997 Milliman et al. ..... 118/405
RE35,879 E * 8/1998 Castelli et al. ..... 427/461
5,922,141 A * 7/1999 Darsey ..... 134/15
6,129,045 A * 10/2000 Amano et al. ..... 118/716
6,267,822 B1 * 7/2001 Watkins ..... 134/37
6,845,928 B1 1/2005 Felgen
2010/0120350 A1 * 5/2010 Pucciani ..... 454/188

* cited by examiner

LOW PRESSURE BLOW-OFF ASSEMBLIES AND RELATED METHODS

CROSS-REFERENCE TO RELATED APPLICATION

This application claims the benefit of U.S. Provisional Application No. 61/030,920, filed on Feb. 22, 2008. The entire disclosure of this application is incorporated herein by reference.

FIELD

The present disclosure generally relates to blow-off assemblies, and more particularly to low pressure blow-off assemblies and related methods, for example, suitable for providing convergent air flow patterns around continuous length, three-dimensionally shaped objects and/or products.

BACKGROUND

The statements in this section merely provide background information related to the present disclosure and may not constitute prior art.

Blow-off fixtures, air wipe fixtures, etc. use air to cool, dry, etc. materials moving through the fixtures. Continuously fed materials (e.g., extruded plastics that need to be cooled, cables that need to be dried, etc.) are moved through the fixtures, and air flowing to the fixtures (e.g., from an external air source) is directed through openings toward the continuously fed materials for operation to cool, dry, etc. the materials. Required air usage for these fixtures may be upwards of 20 pounds per square inch gage (PSIG), or greater.

SUMMARY

The present disclosure is generally related to blow-off assemblies. In one exemplary embodiment, a blow-off assembly provides converging airflow around one or more objects moving through the assembly. The blow-off assembly generally includes a body having an interior wall and an exterior wall. The interior wall defines a bore extending through the body for receiving one or more objects through the blow-off assembly. The exterior wall surrounds the interior wall and defines an air reservoir within the body generally between the exterior wall and interior wall. A cap is configured to be coupled to the body to cover at least part of the air reservoir. The bore includes a generally tapered end and the cap includes a generally tapered inner lip. The tapered end of the bore and the tapered inner lip of the cap define an opening therebetween for discharging air from the air reservoir through the opening in a generally converging airflow pattern around the one or more objects passing through the blow-off assembly.

In another exemplary embodiment, a blow-off assembly provides converging airflow around one or more lengths of objects as they approach the assembly. The blow-off assembly generally includes a body having at least one interior wall and at least one exterior wall. The at least one interior wall defines two or more bores extending through the body for receiving one or more lengths of objects through the body, and the at least one exterior wall surrounds the at least one interior wall and defines at least one air reservoir within the body generally between the at least one exterior wall and the at least one interior wall. Two or more caps are configured to be coupled to the body adjacent each of the two or more bores.

In still another exemplary embodiment, a blow-off assembly kit provides converging airflow around one or more objects. The blow-assembly kit generally includes a body configured to receive one or more objects through the body, and two or more caps each configured to be interchangeably coupled to the body. Each of the two or more caps is operable with the body to discharge air from the body in a different converging pattern around the one or more objects as they move toward the body.

In a further exemplary embodiment, a blow-off assembly provides converging airflow around one or more objects as they approach the assembly. The blow-off assembly generally includes a body configured to receive one or more objects through the body, and a cap configured to be coupled to the body. An air source is configured to be coupled to the body for providing pressurized air to the body. The air source has an air pressure of about twelve pounds per square inch gage or less. The body and the cap define an opening for discharging air from the body through the opening in a generally converging airflow pattern around the one or more objects passing through the body. The opening includes a width dimension extending between the body and the cap, and the cap is moveable relative to the body to adjust the width dimension of the opening and control a volume of air discharged from the body.

In another exemplary embodiment, a blow-off assembly provides converging airflow around one or more lengths of objects as they approach the assembly. The blow-off assembly generally includes a body configured to receive one or more lengths of objects through the body, and a cap configured to be coupled to the body. The cap and the body define an opening for discharging air from the body through the opening in a generally converging airflow pattern around the one or more lengths of objects as the one or more lengths of objects move through the body. A barrel is disposed adjacent the cap and is configured to receive the one or more lengths of objects through the barrel and re-entrain velocities of air discharged from the body for subsequent discharge in a generally converging airflow pattern around the one or more lengths of objects as the one or more objects move through the barrel.

Further areas of applicability will become apparent from the description provided herein. It should be understood that the description and specific exemplary embodiments are intended for purposes of illustration only and are not intended to limit the scope of the present disclosure.

DRAWINGS

The drawings described herein are for illustration purposes only and are not intended to limit the scope of the present disclosure in any way.

DESCRIPTION

Figure 1:
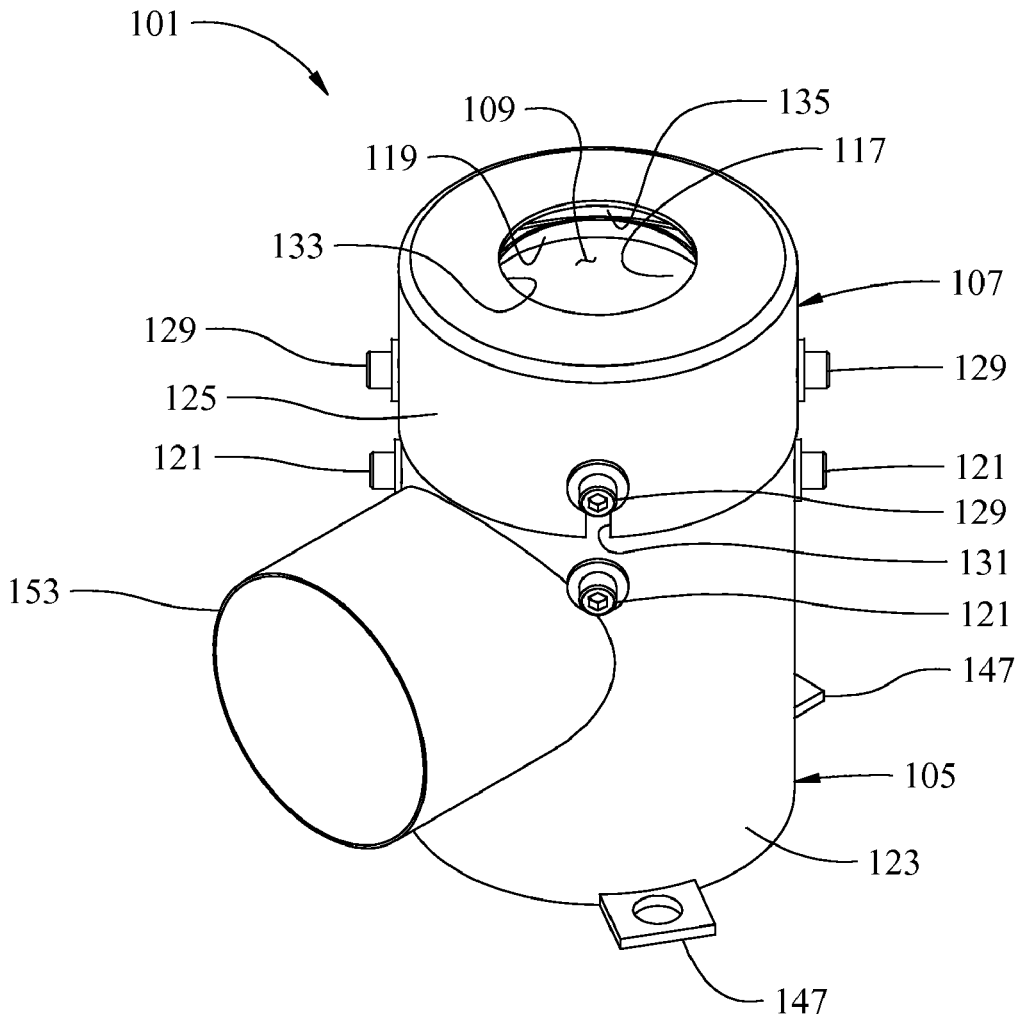
FIG. 1 is a side perspective view of a blow-off assembly according to one exemplary embodiment of the present disclosure.

The following description is merely exemplary in nature and is not intended to limit the present disclosure, application, or uses. It should be understood that throughout the drawings, corresponding reference numbers indicate like or corresponding parts and features.

In accordance with various exemplary embodiments of the present disclosure, the inventors hereof have developed assemblies and methods suitable for use with continuous length, three-dimensionally shaped objects and/or products (e.g., lines of cables, wires, extruded metals, extruded plastics, extruded rubbers, etc.). For example, the assemblies and methods disclosed herein may provide convergent air flow patterns around the objects and/or products (for example, as the objects and/or products approach and pass through the assemblies, etc.) for removing fluids, particles, cuttings, shavings, etc. from the objects and/or products; for air cooling the objects and/or products; for removing debris from the objects and/or products; for impact cleaning the objects and/or products; etc. Furthermore, the assemblies and methods disclosed herein may be used with low-pressure compressed air supplies, for example air supplies with input pressures less than about 12 PSIG, etc., to provide the convergent air flow patterns around the objects and/or products.

Referring now to the drawings, FIGS. 1-7 illustrate an exemplary embodiment of a blow-off assembly 101 embodying one or more aspects of the present disclosure. The illustrated blow-off assembly 101 is configured (e.g., sized, shaped, constructed, etc.) to receive a continuous length of cable 102 (see, e.g., FIGS. 6 and 7, etc.) through the assembly 101 for drying the cable 102 as it approaches and passes through the assembly 101. As used herein, continuous length generally indicates a long, extended length of material (e.g., a cable, etc.), etc., that may be fed, for example, through the blow-off assembly 101 for drying (e.g., removing fluid from the material, etc.), etc. In other exemplary embodiments, blow-off assemblies may be used for removing other than fluids from material, for example, particles, cuttings, shavings, etc.

With reference to FIGS. 1-5, the illustrated blow-off assembly 101 generally includes a tubular-shaped body 105 and a circular-shaped cap 107 configured (e.g., sized, shaped, constructed, etc.) to couple to the body 105 (e.g., FIG. 1, etc.). The body 105 includes a central bore 109 extending through the body 105, and an air reservoir 111 surrounding the central bore 109 (e.g., FIGS. 2 and 3, etc.). A rearward end of the air reservoir 111 is generally closed by a rearward wall 115 of the body 105 (e.g., FIGS. 3 and 4, etc.); and a forward end of the air reservoir 111 is generally open (e.g., FIGS. 3 and 5, etc.). An interior wall 117 generally defines the central bore 109 and separates the air reservoir 111 from the central bore 109 (e.g., FIGS. 2 and 3, etc.). The interior wall 117 is coupled to the body 105 at the body's rearward wall 115 (e.g., by a weld connection, a solder connection, an epoxy connection, etc.) and extends from the rearward wall 115, through the body 105, and through a forward, open end of the body 105. At the forward, open end of the body 105, the interior wall 117 extends out of the body 105 with the central bore 109 terminating in a generally tapered end 119 (e.g., FIGS. 2 and 3, etc.). Spacing pins 121 are provided around the body 105 between an exterior wall 123 of the body 105 and the interior wall 117. The spacing pins 121 help maintain structural integrity of the body 105 during operation (e.g., relative spacing between the exterior wall 123 and interior wall 117 when pressurized air is introduced into the body's air reservoir 111, etc.).

The cap 107 couples to the body 105 at the body's forward, open end. In this position, the cap 107 generally covers the air reservoir 111 such that the air reservoir 111 is generally defined within the body 105 by the cap 107, the body's rearward wall 115, the body's exterior wall 123, and the body's interior wall 117. The cap 107 includes a side wall 125 configured (e.g., sized, shaped, constructed, etc.) to slide over the body's exterior wall 123. Fasteners 129 (e.g., screws, bolts, clips, etc.) are positioned around the body's exterior wall 123 (adjacent the forward, open end of the air reservoir 111) to help couple the cap 107 to the body 105. In the illustrated embodiment, the cap 107 slides longitudinally onto the body 105. The fasteners 129 generally align with slot openings 131 in the cap's side wall 125 to help position the cap 107 over the body 105 and help inhibit rotation of the cap 107 relative to the body 105 once installed. The fasteners 129 can be adjusted (e.g., tightened, etc.) to help hold, secure, etc. the cap 107 in position on the body 105. After the cap 107 is coupled to the body 105, the fasteners 129 may be adjusted (e.g., loosened, etc.), if desired, to allow the cap 107 to be removed from (e.g., slid off, etc.) the body 105.

Figure 3:
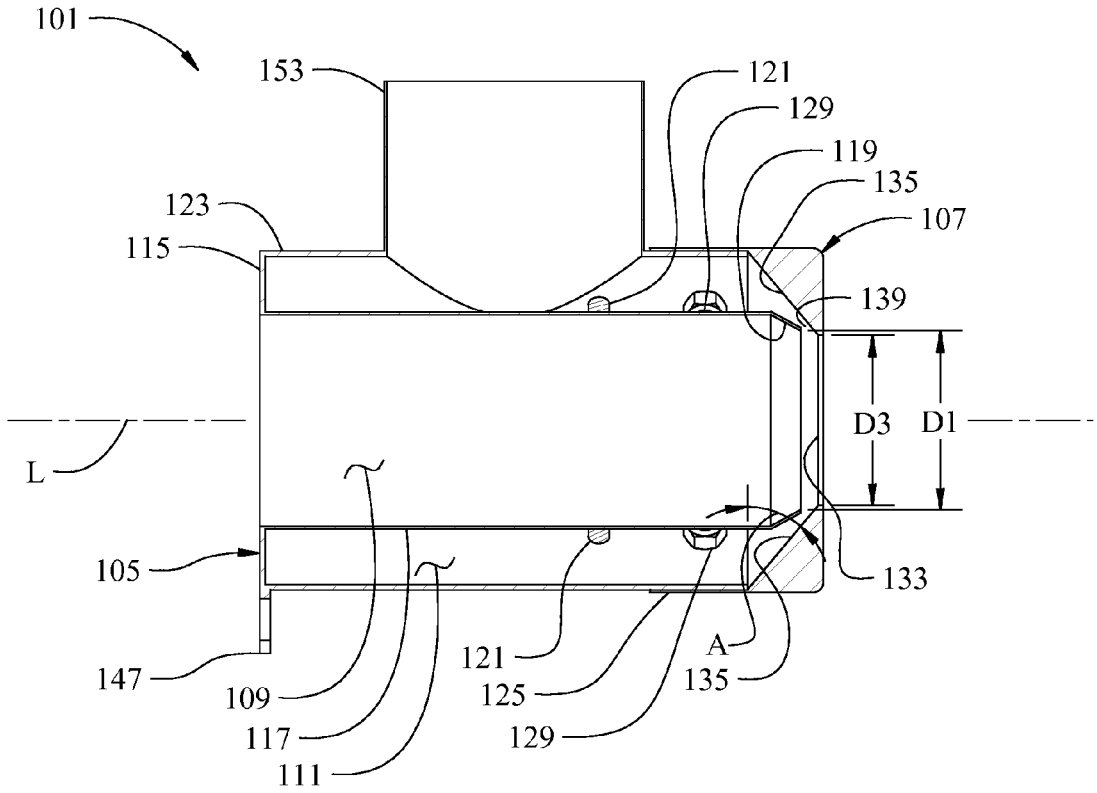
FIG. 3 is a longitudinal section view of the blow-off assembly of FIG. 1.
Figure 4:
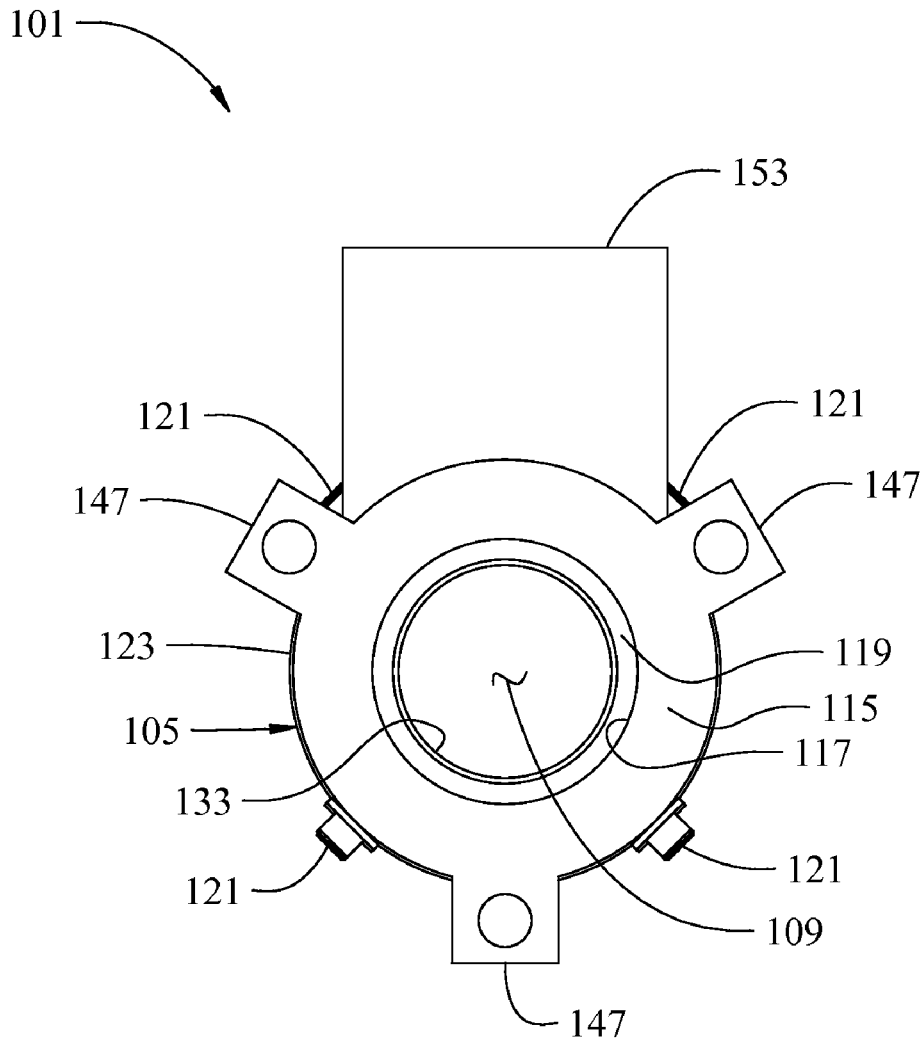
FIG. 4 is a rear end elevation view of the blow-off assembly of FIG. 1.
Figure 5:
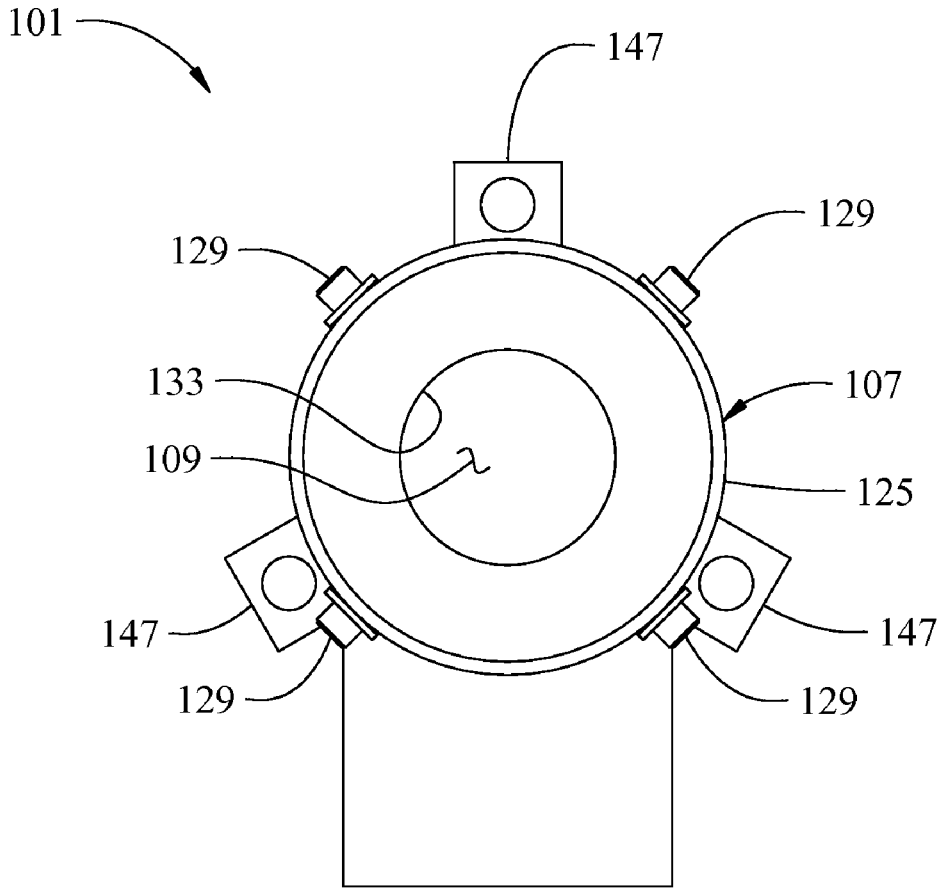
FIG. 5 is a front end elevation view of the blow-off assembly of FIG. 1.

The cap 107 includes a central opening 133 that generally aligns with the central bore 109 of the body 105 when the cap 107 is coupled to the body 105 (e.g., FIG. 3, etc.). This allows the cable 102 (e.g., FIG. 7, etc.) to pass through the blow-off assembly 101 (i.e., through the cap's central opening 133 and through the body's central bore 109) during operation. The cap's central opening 133 is generally defined by a tapered inner lip 135 that extends around the central opening 133. In the illustrated embodiment, the cap's tapered inner lip 135 includes an angle A of about 40 degrees relative to a radial dimension of the cap 107 (e.g., FIG. 3, etc.). In other exemplary embodiments, blow-off assemblies may include caps with tapered inner lips having angles that are less than or greater than about 40 degrees. For example, caps may have tapered inner lips with angles of about 18 degrees, about 28 degrees, about 60 degrees, etc.

As shown in FIG. 3, when the cap 107 is coupled to the body 105, the tapered end 119 of the body's central bore 109 is positioned adjacent the cap's tapered inner lip 135. A diameter D1 of the central bore's tapered end 119 is generally larger than a diameter D3 of the cap's central opening 133. So when the cap 107 is coupled to the body 105, the central bore's tapered end 119 is positioned radially outwardly of (and away from) the cap's central opening 133. This defines a gap 139 (also, a spacing, an opening, etc.) between the central bore's tapered end 119 and the cap's tapered inner lip 135 that allows air to be discharged from the air reservoir 111 through the gap 139, generally forward of the cap 107, during operation (e.g., for use in drying the cable 102 as it approaches the blow-off assembly 101 (e.g., FIGS. 6 and 7, etc.), etc.). This will be described in greater detail hereinafter.

The size of the gap 139 (e.g., a width dimension between the central bore's tapered end 119 and the cap's tapered inner lip 135, etc.) defined by the central bore's tapered end 119 and the cap's tapered inner lip 135 can be adjusted by moving the cap 107 relative to the body 105 (e.g., longitudinally sliding the cap 107 in a direction generally parallel to a longitudinal axis L of the body 105, etc.). Adjusting the size of the gap 139 helps control the volume of air being discharged from the air reservoir 111 during operation. Controlling the operational air volumes (as well as operational air exit velocities from the assembly 101) can help accommodate variations and/or changes in surface textures of a cable passing through the blow-off assembly 101, different movement speeds of a cable through the assembly 101, etc.

Figure 2:
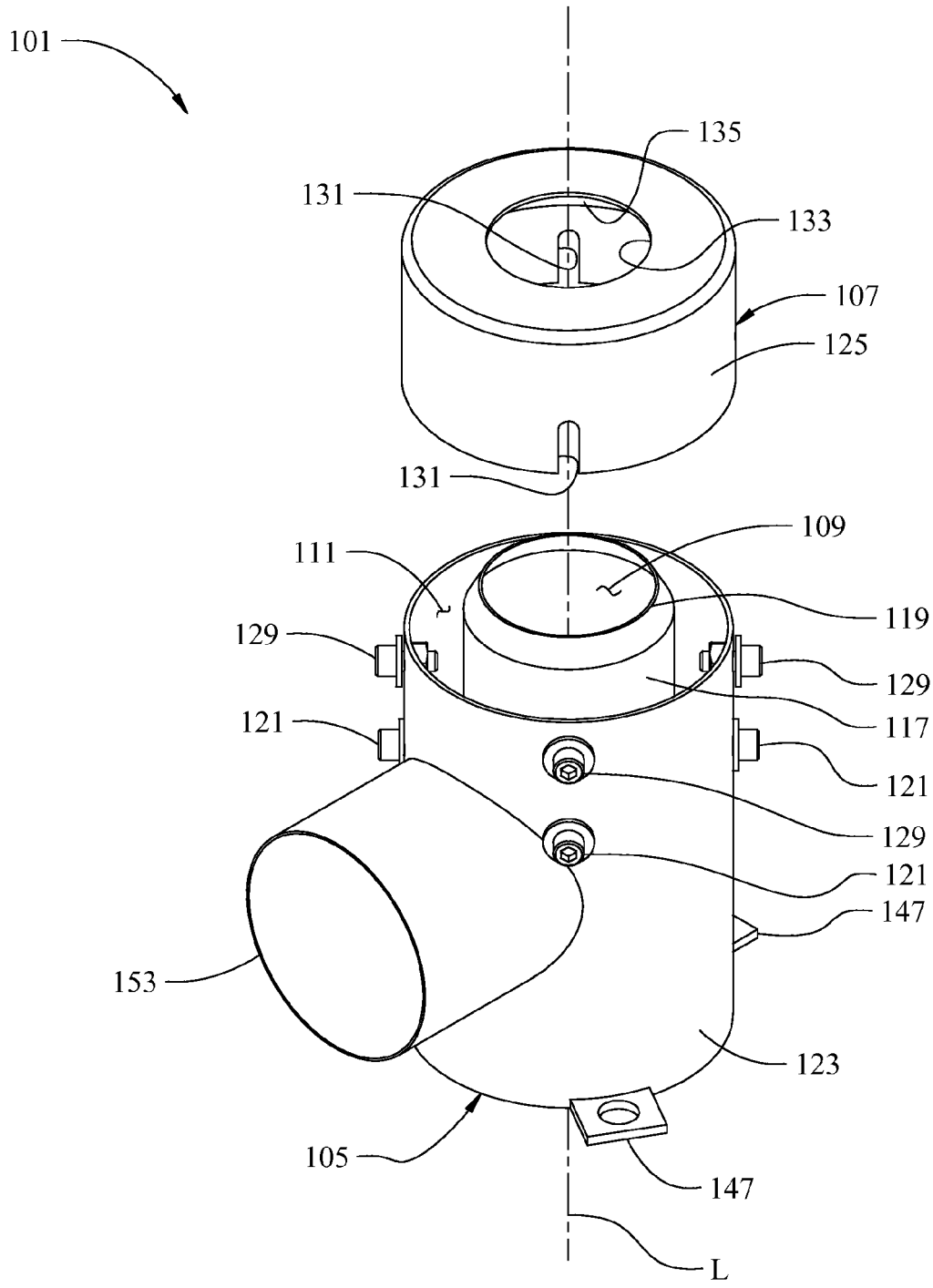
FIG. 2 is the side perspective view of FIG. 1 with a cap of the blow-off assembly shown positioned generally above a body of the blow-off assembly.

The size of the gap 139 can be increased by sliding the cap 107 in a longitudinal direction off of the body 105 (e.g., generally upwardly in FIGS. 1 and 2, etc.). The larger gap 139 discharges a larger volume of air from the assembly 101. The size of the gap 139 can be decreased by sliding the cap 107 in a longitudinal direction onto the body 105 (e.g., generally downwardly in FIGS. 1 and 2, etc.). The smaller gap 139 discharges a smaller volume of air from the assembly 101. The fasteners 129 coupling the cap 107 to the body 105 may be adjusted to allow the cap 107 to slide longitudinally along the body 105, either onto the body 105 to reduce the size of the gap 139 or off of the body 105 to increase the size of the gap 139. In the illustrated embodiment, the size of the gap 139 may be adjusted between about 0.020 inches (about 0.050 centimeters) and about 0.300 inches (about 0.762 centimeters). In other exemplary embodiments, blow-off assemblies may have bodies and caps generally defining gaps that may define sizes less than about 0.020 inches (about 0.050 centimeters) and/or sizes greater than about 0.300 inches (about 0.762 centimeters).

Figure 6:
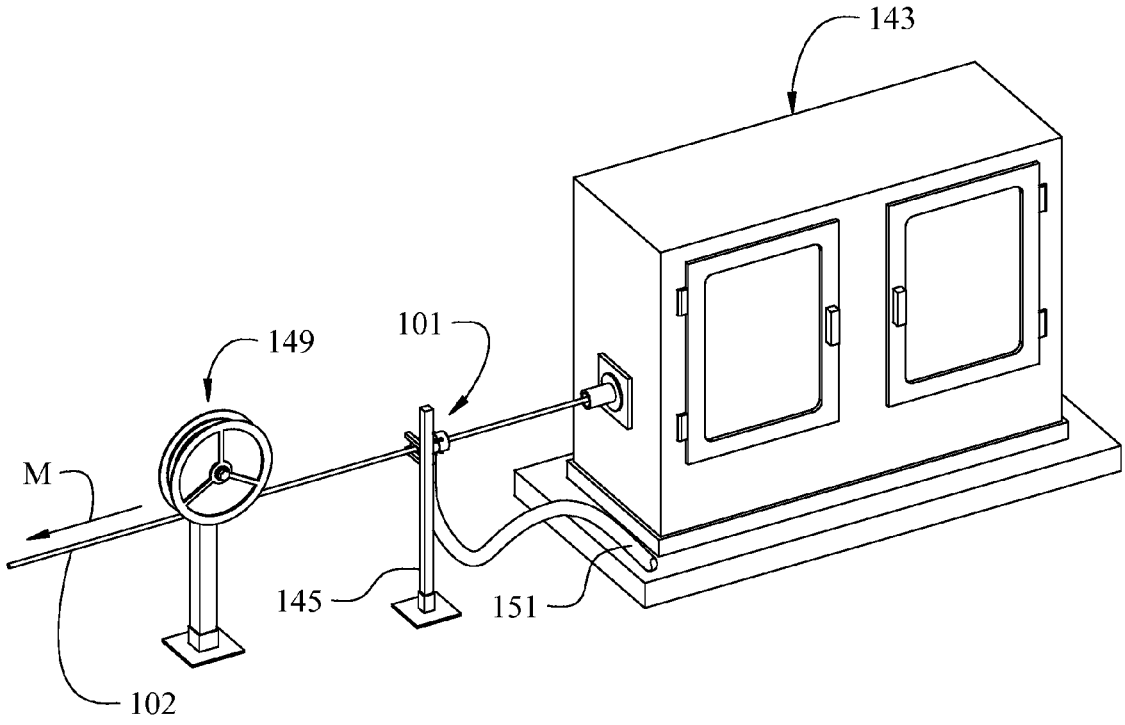
FIG. 6 is a perspective view of the blow-off assembly of FIG. 1 installed adjacent a cable processing station in position for operation with a cable as the cable exits the processing station.
Figure 7:
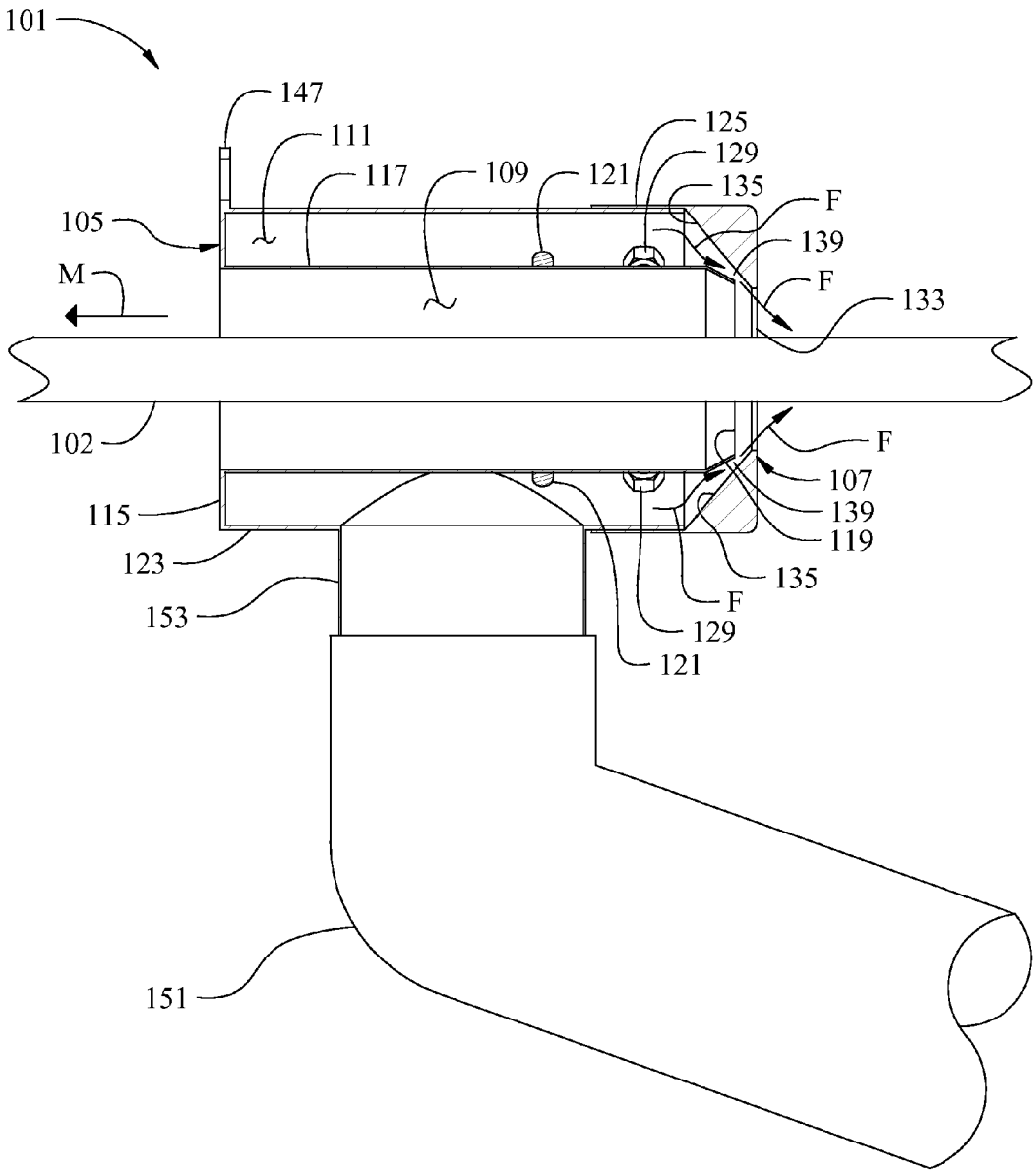
FIG. 7 is an enlarged side elevation view of the blow-off assembly of FIG. 6 with part of the body and cover of the blow-off assembly broken away to show internal construction and operation.

Exemplary operation of the illustrated blow-off assembly 101 will now be described with reference to FIGS. 6 and 7. The blow-off assembly 101 is initially located, for example, adjacent a cable processing station 143 for convenient operation with the cable 102 as it exits the processing station 143. The cable processing station 143 may include, for example, a cable cooling station, a cable extruding station, etc. that may, for example, make use of different fluids to clean, cool, etc. the cable 102 prior to the cable 102 exiting the processing station 143. The blow-off assembly 101 can then operate to remove the fluids from the cable 102 prior to storing, transporting, etc. the cable 102.

In the illustrated setup, the blow-off assembly 101 is mounted on an adjustable support stand 145 (e.g., by wing mounts 147 (e.g., FIG. 1, etc.), etc.) such that a height of the assembly 101 can be adjusted to position the cable 102 closely through a center of the assembly 101 (e.g., through centers of the cap's central opening 133 and the body's central bore 109, etc.). A free end of the cable 102 extends from the processing station 143 and through the blow-off assembly 101 (through the cap's central opening 133 and then through the body's central bore 109). From the blow-off assembly 101, the cable 102 may then pass through a guide roller 149 to help maintain the cable's positioning closely through the center of the blow-off assembly 101. The cable 102 may then extend to a spool (not shown) for rolling, storing, transporting, combinations thereof, etc. the processed cable 102.

An air supply line 151 is connected to the blow-off assembly 101 at an air inlet 153 (e.g., FIG. 7, etc.) of the body 105 to provide air (e.g., from any suitable available source of air, including low pressure sources, etc.) to the assembly 101 for discharge during operation. With reference to FIG. 7, air enters the blow-off assembly 101 through the air inlet 153 and fills the air reservoir 111 within the body 105. Air within the air reservoir 111 then discharges from the body 105 through the gap 139 defined between the tapered end 119 of the body's central bore 109 and the tapered inner lip 135 of the cap 107. The tubular shape of the air reservoir 111 and the corresponding circular shape of the cap's central opening 133 help direct the discharged air in a generally uniform 360 degree pattern around the cable 102 as the cable 102 approaches the blow-off assembly 101. In addition, the tapered shapes of the central bore's end 119 and the cap's inner lip 135 help direct the discharged air in a forward direction relative to the cap 107, and in an inward direction toward the cable 102 (e.g., FIG. 7, etc.). The tapered shapes also help reduce friction losses in the air flow as the air moves from the air reservoir 111, past the central bore's tapered end 119, and around the cap's tapered inner lip 135. Moreover, the specific angle A (e.g., FIG. 3, etc.) of the taper of the cap's inner lip 135 (e.g., about 40 degrees in the illustrated embodiment, etc.) helps control an angle of convergence of the discharged air around the cable 102 (and the distance the air is directed forward of the cap 107 before converging around the cable 102). In the illustrated embodiment, the 40 degree angle A of the cap's tapered inner lip 135 results in the air converging around the cable 102 between about 2 inches and about 3 inches forward of the cap 107.

In the illustrated embodiment, the cable 102 moves from the processing station 143 (e.g., covered with cooling fluid, etc.), through the blow-off assembly 101, and to a spool, etc. in a direction indicated by arrow M. A generally continuous stream of air is discharged from the blow-off assembly 101 forward of the cap 107 and around the cable 102 as the cable moves (arrows F in FIG. 7 indicate air flow). The discharged air then contacts the cable 102 as it approaches the blow-off assembly 101 (and before it enters the blow-off assembly 101) and removes any fluid remaining on the cable 102 after leaving the processing station 143. It may be understood that the fluid is generally air blasted from the cable's surface during this operation. The dried cable 102 then passes through the blow-off assembly 101, and to a spool, etc. for storage, transport, combinations thereof, etc.

Figure 8:
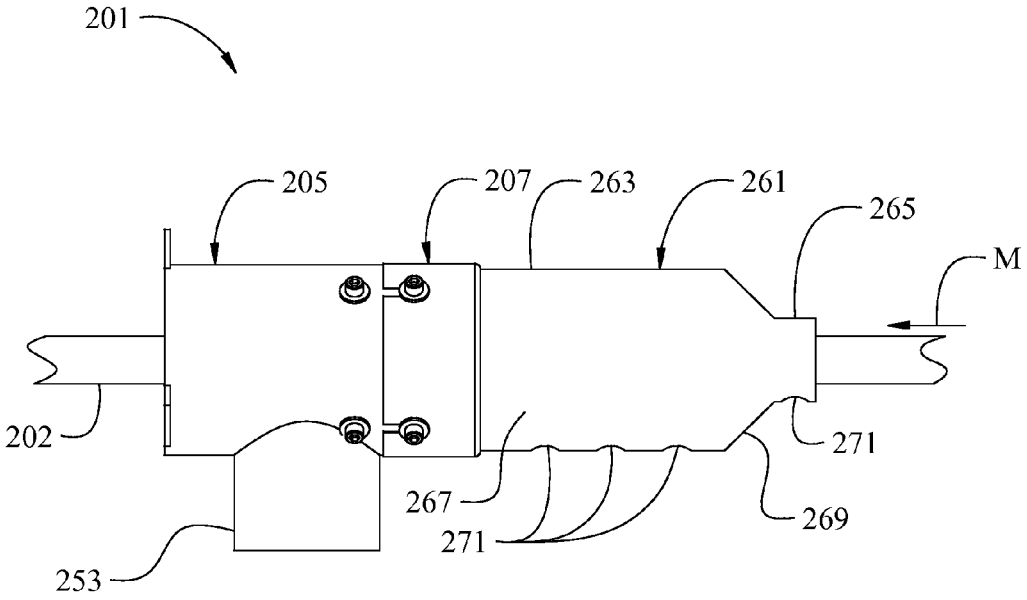
FIG. 8 is a side elevation view of a blow-off assembly according to another exemplary embodiment of the present disclosure.
Figure 9:
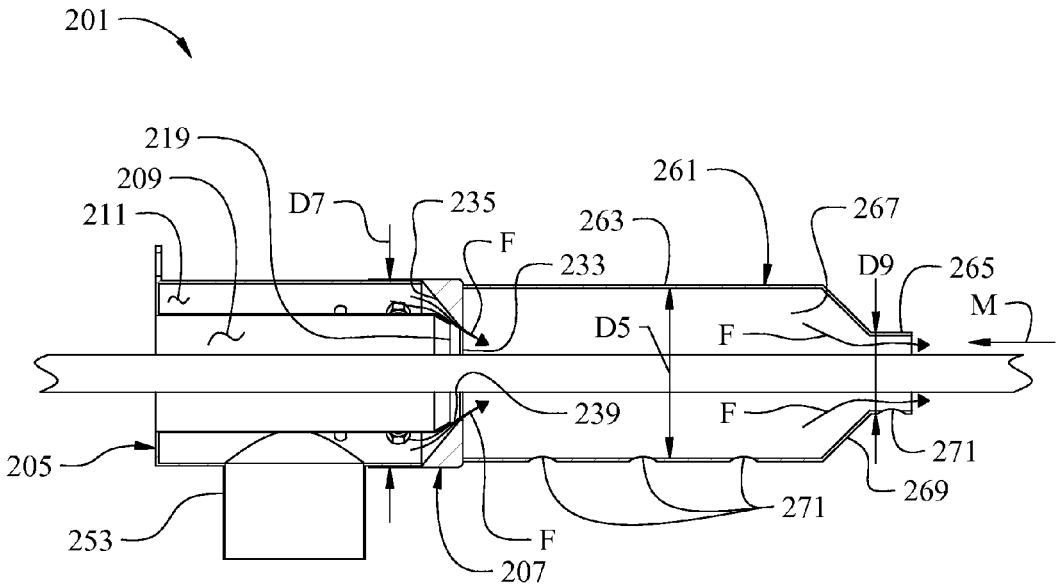
FIG. 9 is the side elevation view of FIG. 8 with part of a body, a cover, and a barrel of the blow-off assembly broken away to show internal construction and operation.

FIGS. 8 and 9 illustrate another exemplary embodiment of a blow-off assembly 201 embodying one or more aspects of the present disclosure. The blow-off assembly 201 of this embodiment is similar to the blow-off assembly 101 previously described and illustrated in FIGS. 1-7. The blow-off assembly 201 generally includes a tubular-shaped body 205 and a circular-shaped cap 207. When the cap 207 is coupled to the body 205, a central opening 233 of the cap 207 generally aligns with a central bore 209 of the body 205 such that a tapered end 219 of the central bore 209 is positioned adjacent a tapered inner lip 235 of the cap 207. This defines a gap 239 (also, a spacing, opening, etc.) between the central bore's tapered end 219 and the cap's inner lip 235 that allows air to discharge from the body 205 in a converging airflow pattern around a cable 202 approaching the blow-off assembly 201 during operation (arrow M indicates movement of the able 202 through the blow-off assembly 201).

The blow-off assembly 201 of this embodiment also includes a barrel 261 positioned forward of the body 205 and cap 207. The barrel 261 helps redirect and/or refocus air discharged from the body 205 (which has already converged around the cable 202 a first time) such that the redirected and/or refocused air converges around the cable 202 at least a second time for additional operation to dry, cool, clean, etc. the cable 202 as the cable 202 moves through the blow-off assembly 201. In addition, the barrel 261 helps re-entrain velocities of the air within the barrel 261 for subsequent discharge from the barrel 261 at a forward end for further convergence around the cable 202 at a location forward of the barrel 261. This provides further drying, cooling, cleaning, etc. of the cable 202 as the cable 202 approaches the barrel 261. The barrel 261 can also help dampen noise associated with air being discharged from the body 205. In other exemplary embodiments, blow-off assemblies my include two or more barrels (e.g., in series, etc.) for helping redirect air, refocus air, etc. to converge around cables two or more times for additional operation to dry, cool, clean, etc. the cables as they approach and move through the blow-off assemblies.

The illustrated barrel 261 includes a first section 263 located adjacent the cap 207, and a second section 265 of reduced diameter located forward of the first section 263. The barrel's first section 263 is positioned in abutment with the cap 207 and generally aligned with the cap's central opening 233 and the body's central bore 209. The illustrated first section 263 includes a diameter D5 dimensioned similar to a diameter D7 of the cap 207; and the illustrated second section 265 includes a diameter D9 smaller than the diameter D5 of the first section 263 and similar to a diameter of the cap's central opening 233. It is to be understood that the barrel 261 may have different relative diameters within the scope of the present disclosure. In other exemplary embodiments, blow-off assemblies may include barrels spaced apart from caps (e.g., not in abutment, etc.). In still other exemplary embodiments, blow-off assemblies may include barrels formed integrally, or monolithically, with at least part of bodies and/or caps of the assemblies.

In operation of the illustrated blow-off assembly 201, air enters an air reservoir 211 of the assembly 201 through an air inlet 253 of the body 205 and discharges from the body 205 through the gap 239 defined by the central bore's tapered end 219 and the cap's tapered inner lip 235. The discharged air is initially directed forward of the cap 207 and generally inward toward the cable 202 within the first section 263 of the barrel 261 (where it converges a first time around the cable 202). As the converging air moves past the cable 202, it engages a side wall 267 of the barrel 261 which reduces velocity of the air (e.g., frictional forces between the air and the barrel's side wall 267 reduce the air's velocity (e.g., velocity decay, etc.), etc.) and redirects (e.g., reflects, deflects, etc.) the air generally forward of the barrel 261 and/or generally back toward the cable 202. This creates a highly turbulent zone of air around the cable 202 within the first section 263 of the barrel 261 that may provide additional drying operation on the cable 202 as it passes through the barrel 261. The reduced velocity of the air through the barrel 261 may vary according to, among other things, the length of the barrel 261 and/or the surface features of the barrel 261 and/or the surface features of the cable 202. The turbulent air continues through the first section 263 of the barrel 261 and into the second section 265 of the barrel 261. The reduced diameter of the barrel's second section 265 compresses the air and increases its velocity. And a generally tapered connection 269 between the first section 263 and the second section 265 redirects the accelerated air in a converging airflow pattern around the cable 202 as the cable 202 approaches the barrel 261. The converging air contacts the cable 202 forward of the barrel 261, for example, for further drying operation on the cable 202, etc. Air flow through the blow-off assembly 201 is generally indicated by arrows F in FIG. 9.

It should be appreciated that the converging air from the illustrated blow-off assembly 201 can be used, for example, to remove residual fluid on the cable 202 following a cooling process (e.g., following a process where fluid is used to cool a formed cable 202, etc.), etc. Accordingly, openings may be located within the first and/or second sections 263 and 265 of the barrel 261 to help allow any fluid removed from the cable 202 within the barrel 261 to drain from the barrel 261 without interfering with operation of the blow-off assembly 201. In the illustrated blow-off assembly 201, drain openings 271 are located within both the first and second sections 263 and 265 of the barrel 261. In other exemplary embodiments, blow-off assemblies may include barrels in which first and/or second section of the barrels are sloped to allow fluid to drain from the barrels, for example, through drain openings, etc.

In another exemplary embodiment, a blow-off assembly similar to the blow-off assembly previously described and illustrated in FIGS. 8 and 9 generally includes a stainless steel body, a stainless steel cap configured (e.g., sized, shaped, constructed, etc.) to couple to the body, and a polyvinyl chloride (PVC) barrel positioned forward of the cap. In this embodiment, the body includes a length of about 6 inches (about 15.2 centimeters) and an outer diameter of about 4 inches (about 10.2 centimeters). And an air inlet of the body includes an opening having a diameter of about 3 inches (about 7.6 centimeters) for receiving air from, for example, a supply line to provide air to the blow-off assembly during operation.

In this embodiment, an interior wall of the body generally defines a central bore of the blow-off assembly's body. The central bore includes a tapered end having a diameter of about 2.375 inches (about 6.033 centimeters). The cap includes a central opening that generally aligns with the body's central bore when the cap is coupled to the body. The cap's central opening has a diameter similar to the diameter of the central bore's tapered end of about 2.375 inches (about 6.033 centimeters). The barrel includes a first section having a length of about 10 inches (about 25.4 centimeters) and a diameter of about 2.5 inches (about 6.4 centimeters), and a second section having a length of about 2 inches (about 5.1 centimeters) and a diameter of about 2 inches (about 5.1 centimeters). This exemplary blow-off assembly may thus accommodate objects and/or products (e.g., cables, etc.) having, for example, general diameter dimensions ranging from about 0.125 inches (about 0.318 centimeters) to about 1.625 inches (about 4.128 centimeters).

In addition in this embodiment, a tapered end of the body's central bore is positioned adjacent a tapered inner lip of the cap, defining a gap (also, a spacing, opening, etc.) therebetween which allows air to discharge from the body during operation around a cable as it approaches the blow-off assembly. The size of the gap may be adjusted (depending on the relative positioning of the cap on the body) from about 0.020 inches (about 0.051 centimeters) to about 0.300 inches (about 0.762 centimeters) to control the volume of air being discharged from the blow-off assembly. In this embodiment, exit velocity of air from the blow-off assembly may range from about 2,000 feet/minute (about 609.6 meters/minute) to about 60,000 feet/minute (about 18,288 meters/minute). But it should be appreciated that exit velocity may vary with operating temperature of the blow-off assembly. In addition, the cap's tapered inner lip includes an angle of about 40 degrees relative to a radial dimension of the cap such that air discharged from the body is directed in a converging pattern around an approaching cable about 2.5 inches (about 6.4 centimeters) forward of the cap. Moreover, air within the barrel is accelerated as it moves from the first section (larger diameter) into the second section (smaller diameter) for subsequent discharge forward of the barrel and around the cable.

Figure 10:
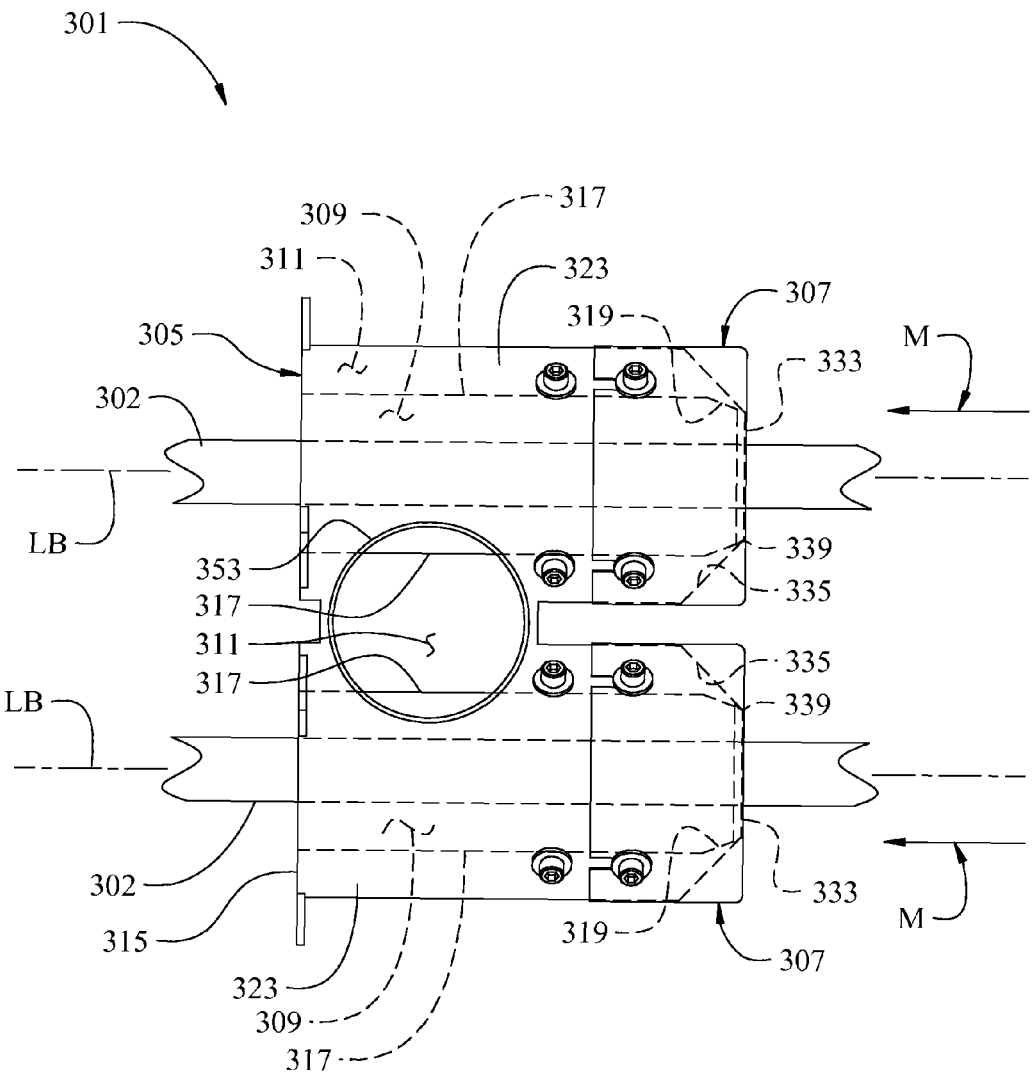
FIG. 10 is a bottom plan view of a blow-off assembly according to still another exemplary embodiment of the present disclosure.

FIG. 10 illustrates another exemplary embodiment of a blow-off assembly 301 embodying one or more aspects of the present disclosure. The blow-off assembly 301 of this embodiment is similar to the blow-off assembly 101 previously described and illustrated in FIGS. 1-7. In this embodiment, however, the blow-off assembly 301 is configured (e.g., sized, shaped, constructed, etc.) to process (e.g., dry, cool, clean, etc.) two cables (each indicated at 302) extending generally parallel through the blow-off assembly 301.

The blow-off assembly 301 of this embodiment generally includes a manifold-type body 305 having two bores 309 extending generally parallel through the body 305 (e.g., longitudinal axes LB of the bores 309 are generally parallel, etc.). The bores 309 are each generally defined by interior walls 317 supported within the body 305 (e.g., at a rearward wall 315 of the body 305, by spacing pins (not shown) coupled to an exterior wall 323 of the body 305, etc.). An air reservoir 311 is defined around the two bores 309 generally between the exterior wall 323 of the body 305 and the two interior walls 317. An air inlet 353 is provided in fluid communication with the air reservoir 311 to allow air from any suitable air source to be supplied into the air reservoir 311.

Caps 307 are configured (e.g., sized, shaped, constructed, etc.) to fit over the body 305 generally at the bores 309. The caps 307 each include a central opening 333 that aligns with the respective bore 309 of the body 305 when the cap 307 is coupled to the body 305 such that one of the cables 302 may pass through each of the cap openings 333 and their corresponding body bores 309. In this position, a tapered end 319 of each bore 309 is positioned adjacent a tapered inner lip 335 of its corresponding cap 307 with a gap 339 (also, spacing, opening, etc.) defined therebetween to allow air to discharge from the body 305 in a converging pattern around each of the cables 302 as the cables 302 approach the blow-off assembly 301 during operation. Arrow M indicates movement of the cable 302 through the blow-off assembly 301.

Operation of the blow-off assembly 301 of this embodiment is substantially similar to that of the blow-off assembly 101 previously described and illustrated in FIGS. 1-7. In this embodiment, however, one cable 302 extends through each of the body's bores 309 such that the two cables 302 may be processed at one time. In other exemplary embodiments, blow-off assemblies may be configured (e.g., sized, shaped, constructed, etc.) to process three or more cables at one time.

Figure 11:
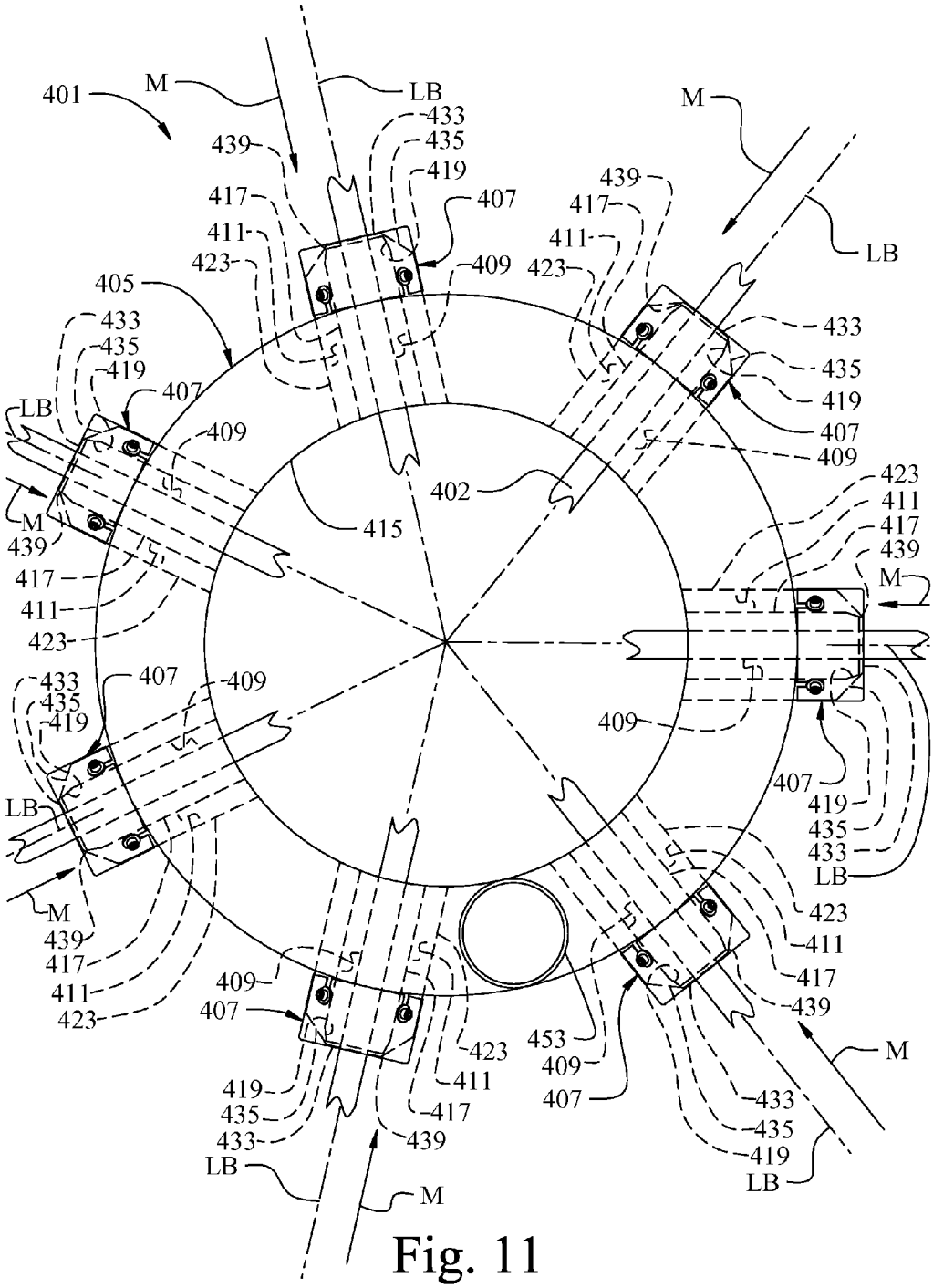
FIG. 11 is a bottom plan view of a blow-off assembly according to a further exemplary embodiment of the present disclosure.

FIG. 11 illustrates still another exemplary embodiment of a blow-off assembly 401 embodying one or more aspects of the present disclosure. The blow off assembly 401 of this embodiment is similar to the blow-off assembly 301 previously described and illustrated in FIG. 10. In this embodiment, however, the blow-off assembly 401 is configured (e.g., sized, shaped, constructed, etc.) to process (e.g., dry, cool, clean, etc.) eight cables (each indicated at 402) extending generally radially through the blow-off assembly 401.

The blow-off assembly 401 of this embodiment generally includes a manifold-type, donut-shaped body 405 having eight bores 409 arranged generally radially through the body 405 (e.g., e.g., longitudinal axes LB of the bores 409 are generally arranged in a rosette configuration, etc.). The bores 409 are each generally defined by interior walls 417 supported within the body 405 (e.g., at a rearward wall 415 of the body 405, by spacing pins (not shown) coupled to an exterior wall 423 of the body 405, etc.). An air reservoir 411 is defined around the eight bores 409 generally between the exterior wall 423 of the body 405 and the eight interior walls 417. An air inlet 453 is provided in fluid communication with the air reservoir 411 to allow air from any suitable air source to be supplied into the air reservoir 411.

Caps 407 are configured (e.g., sized, shaped, constructed, etc.) to fit over the body 405 generally at the bores 409. The caps 407 each include a central opening 433 that aligns with the respective bore 409 of the body 405 when the cap 407 is coupled to the body 405 such that one of the cables 402 may pass through each of the cap openings 433 and their corresponding body bores 409. In this position, a tapered end 419 of each bore 409 is positioned adjacent a tapered inner lip 435 of its corresponding cap 407 with a gap 439 (also, spacing, opening, etc.) defined therebetween to allow air to discharge from the body 405 in a converging pattern around each of the cables 402 as the cables 402 approach the blow-off assembly 401 during operation. Arrows M indicates movement of the cable 402 through the blow-off assembly 401.

Operation of the blow-off assembly 401 of this embodiment is substantially similar to that of the blow-off assembly 101 previously described and illustrated in FIGS. 1-7. In this embodiment, however, one cable 402 extends through each of the body's bores 409 such that the eight cables 402 may be processed at one time. Moreover, in the illustrated embodiment the eight processed cables 402 are moved radially to a common location, for example, within a central area of the blow-off assembly's body 405 (as indicated by arrows M) for combining the cables 402 into a single structure, etc. In other exemplary embodiments, cables may be moved through blow-off assemblies in opposite directions to that illustrated herein. For example, cables may be moved from a common location (e.g., within a central area of a blow-off assembly's body, etc.) to separate locations (e.g., outside the central area of the blow-off assembly's body, etc.).

In other exemplary embodiments, two or more blow-off assemblies may be used in combination to process (e.g., dry, cool, clean, etc.) two or more objects and/or products.

In another exemplary embodiment, a blow-off assembly includes multiple interchangeable caps each configured (e.g., sized, shaped, constructed, etc.) to fit over a body of the assembly. The caps each include tapered inner lips such that the tapered inner lip of each cap includes a different angle (e.g., relative to a radial dimension of the cap, etc.), for example, for converging air around a cable a different distance forward of the respective cap. For example, the caps may have tapered inner lips with angles of about 18 degrees, 28 degrees, 40 degrees, 60 degrees, etc. As the angle of the cap's tapered inner lip increases, the distance air converges in front of the cap increases. Thus, the different caps may each be used with the body for different operations (e.g., drying operation, cooling operation, cleaning operation, etc.) and/or for operations on different objects and/or products.

Blow-off assemblies according to the present disclosure may be used in operation with any object and/or product (e.g., besides just cables, etc.) that can pass through the assemblies (e.g., through caps' openings and through bodies' central bores, etc.). And the blow-off assemblies may be generally configured (e.g., sized, shaped, constructed, etc.) to pass coating globs, lumps, etc. through the assembly without blocking airflow. Furthermore, operational air exit velocities and air volumes may be adjusted as required to accommodate variations and/or changes in surface textures of the object and/or product passing through the assemblies and/or to accommodate different movement speeds of the object and/or product through the assemblies.

Blow-off assemblies according to the present disclosure may provide convergent air pattern designs and air flow rates suitable for removing fluids, particles, cuttings, shavings, etc. from objects and/or products moving through the assemblies. The blow-off assemblies effectively remove fluids, particles, cuttings, shavings, etc. from products prior to the products entering the assemblies. Thus, the fluids, particles, cuttings, shavings, etc. removed from the objects and/or products do not enter the assemblies. In addition, any minerals carried by, for example, fluids, etc. will not be deposited and/or allowed to build up on the assemblies.

Blow-off assemblies according to the present disclosure may be operable with standard facility-supplied air sources and/or utilities, external low-pressure air sources, etc. For example, the assemblies may be used with compressed air supplies already operating within a facility. In addition, the blow-off assemblies may be used with low-pressure compressed air supplies, for example air supplies with input pressures less than about 12 PSIG, etc., to provide convergent air flow patterns around objects and/or products as they approach the assemblies. Desired operating pressure may depend, for example, on object and/or product diameter; coating material; conveying speed, etc. Thus, the assemblies may provide improved operating efficiency and reduced utility cost over current/existing high pressure blow-off assemblies. It should be understood, however, that blow-off assemblies may be used with input air pressures greater than about 12 PSIG within the scope of the present disclosure.

Blow-off assemblies according to the present disclosure may be used for non-contact fluid removal, drying, air cooling, debris removal, and/or air impact cleaning of any continuous length, three dimensional product (e.g., cables, wires, extruded metals, extruded plastics, or extruded rubbers). Any contamination and/or damage that may result from physical contact with the processed objects and/or products in traditional operations can here be avoided.

Numerical dimensions and values are provided herein for illustrative purposes only. The particular dimensions and values provided are not intended to limit the scope of the present disclosure.

Certain terminology is used herein for purposes of reference only, and thus is not intended to be limiting. For example, terms such as "upper," "lower," "above," "below," "top," "bottom," "upward," "downward," "upwardly," and "downwardly" refer to directions in the drawings to which reference is made. Terms such as "front," "back," "rear," "bottom," and "side," describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," "third," and other such numerical terms referring to structures do not imply a sequence or order unless clearly indicated by the context.

When introducing elements or features and the exemplary embodiments, the articles "a," "an," "the," and "said" are intended to mean that there are one or more of such elements or features. The terms "comprising," "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A blow-off assembly operable with low-pressure compressed air supplies to provide converging airflow around one or more objects moving through the assembly, the blow-off assembly comprising:

a body having an interior wall and an exterior wall, the interior wall defining a bore extending through the body for receiving one or more objects through the blow-off assembly, and the exterior wall surrounding the interior wall and defining an air reservoir within the body generally between the exterior wall and interior wall;

a cap configured to be coupled to the body to cover at least part of the air reservoir;

wherein the bore includes a generally tapered end and the cap includes a generally tapered inner lip;

wherein the tapered end of the bore and the tapered inner lip of the cap define an opening therebetween for discharging air from the air reservoir through the opening with an exit velocity of at least about 2,000 feet per minute in a generally converging airflow pattern forward of the cap and around the one or more objects passing through the blow-off assembly; and wherein the blow-off assembly is operable with input air pressures of twelve pounds per square inch gauge or less.

2. The blow-off assembly of claim 1, wherein the opening defined by the tapered end of the bore and the tapered inner lip of the cap includes a width dimension extending between the tapered end of the bore and the tapered inner lip of the cap, the cap being moveable relative to the body to adjust the width dimension of said opening.

3. The blow-off assembly of claim 2, wherein body includes a longitudinal axis, the cap being moveable in a direction generally parallel to said longitudinal axis and configured to be coupled to the body at different locations along said longitudinal axis to thereby adjust the width dimension of said opening.

4. The blow-off assembly of claim 2, wherein the width dimension of said opening can be adjusted between about 0.02 inches (about 0.05 centimeters) and about 0.30 inches (about 0.76 centimeters).

5. The blow-off assembly of claim 1, wherein the tapered inner lip of the cap defines an angle and the tapered end of the bore defines an angle, and wherein the angle of the tapered inner lip of the cap is different from the angle of the tapered end of the bore.

6. The blow-off assembly of claim 1, further comprising a barrel for re-entraining velocities of air discharged from the air reservoir.

7. The blow-off assembly of claim 1, further comprising at least one fastener for releasably coupling the cap to the body at different locations along the body to thereby change the width dimension of said opening defined by the tapered end of the bore and the tapered inner lip of the cap.

8. The blow-off assembly of claim 1, wherein the cap includes an opening generally aligned with the bore of the body when the cap is coupled to the body such that the one or more objects received through the blow-off assembly move through the opening of the cap and through the bore of the body.

9. The blow-off assembly of claim 8, wherein the opening of the cap includes a diameter and wherein the tapered end of the bore includes a diameter, the diameter of the opening of the cap being smaller than the diameter of the tapered end of the bore.

10. The blow-off assembly of claim 1, wherein the tapered inner lip of the cap defines an angle relative to a radial dimension of the cap of between about eighteen degrees and about sixty degrees.

11. The blow-off assembly of claim 1, further comprising a source of air coupled to the blow-off assembly, the source of air having a pressure of about twelve pounds per square inch gage or less.

12. The blow-off assembly of claim 1, wherein the body includes two or more bores.

13. A blow-off assembly operable with low-pressure compressed air supplies to provide converging airflow around one or more lengths of objects as they approach the assembly, the blow-off assembly comprising:

a body having at least one interior wall and at least one exterior wall, the at least one interior wall defining two or more bores extending through the body for receiving one or more lengths of objects through the body, and the at least one exterior wall surrounding the at least one interior wall and defining at least one air reservoir within the body generally between the at least one exterior wall and the at least one interior wall; and two or more caps configured to be coupled to the body adjacent each of the two or more bores;

wherein the two or more bores each include a generally tapered end, and wherein the two or more caps each include a generally tapered inner lip;

wherein the tapered end of each of the two or more bores and the respective tapered inner lip of each of the two or more caps coupled to the body adjacent each of the two or more bores define an opening therebetween for discharging air from the air reservoir through the opening with an exit velocity of at least about 2,000 feet per minute in a generally converging airflow pattern forward of the respective cap and around the one or more lengths of objects passing through the blow-off assembly; and wherein the blow-off assembly is operable with input air pressures of twelve pounds per square inch gauge or less.

14. The blow-off assembly of claim 13, wherein the body is configured to receive two or more lengths of objects through the body.

15. The blow-off assembly of claim 13, wherein the two or more bores each include a longitudinal axis, the longitudinal axes of the bores being generally parallel.

16. The blow-off assembly of claim 13, wherein the body is generally circular in shape.

17. A blow-off assembly operable with low-pressure compressed air supplies to provide converging airflow around one or more objects as they approach the assembly, the blow-off assembly comprising:

a body configured to receive one or more objects through the body;

a cap configured to be coupled to the body;

wherein the body and the cap define an opening for discharging air from the body through the opening in a generally converging airflow pattern forward of the cap and around the one or more objects passing through the body;

wherein said opening includes a width dimension extending between the body and the cap, the cap being moveable relative to the body to adjust the width dimension of said opening and control a volume of air discharged from the body;

wherein the blow-off assembly is operable with input air pressures of twelve pounds per square inch gauge or less; and wherein the blow-off assembly is operable to discharge air with an exit velocity of at least about 2,000 feet per minute around the one or more objects as the one or more objects pass through the body.

18. The blow-off assembly of claim 17, wherein the body includes an interior wall and an exterior wall, the interior wall defining a bore extending through the body for receiving the one or more objects through the body, and the exterior wall surrounding the interior wall and defining an air reservoir within the body generally between the exterior wall and interior wall, the air source providing pressurized air to the air reservoir of the body.

19. A blow-off assembly operable with low-pressure compressed air supplies to provide converging airflow around one or more lengths of objects as they approach the assembly, the blow-off assembly comprising:

a body configured to receive one or more lengths of objects through the body;

a cap configured to be coupled to the body, the cap and the body defining an opening for discharging air from the body through the opening in a generally converging airflow pattern forward of the cap and around the one or more lengths of objects as the one or more lengths of objects move through the body;

a barrel disposed adjacent the cap and configured to receive the one or more lengths of objects through the barrel, the barrel re-entraining velocities of air discharged from the body for subsequent discharge in a generally converging airflow pattern around the one or more lengths of objects as the one or more objects move through the barrel;

wherein the blow-off assembly is operable with input air pressures of twelve pounds per square inch gauge or less; and wherein the blow-off assembly is operable to discharge air with an exit velocity of at least about 2,000 feet per minute around the one or more lengths of objects as the one or more lengths of objects move through the body.

20. The blow-off assembly of claim 19, wherein said opening includes a width dimension extending between the body and the cap, the cap being moveable relative to the body to adjust the width dimension of said opening and control a volume of air discharged from the body.

21. The blow-off assembly of claim 19, wherein the barrel comprises a first section having a diameter and a second section having a diameter, and wherein the diameter of the first section of the barrel is greater than the diameter of the second section of the barrel.

* * * * *